United States Patent [19]

Farmer, Jr. et al.

[11] 4,275,347

[45] Jun. 23, 1981

[54] PRECISION CATHODE CURRENT REGULATOR

[75] Inventors: Felta C. Farmer, Jr., Gas City; Donald P. Knight, Marion, both of Ind.

[73] Assignee: RCA Corporation, New York, N.Y.

[21] Appl. No.: 71,387

[22] Filed: Aug. 30, 1979

[51] Int. Cl.[3] ..... G05F 3/08

[52] U.S. Cl. ..... 323/312; 324/404; 324/410

[58] Field of Search ..... 323/1, 4, 9, 20, 22 R; 324/404, 410–412; 315/94, 107, 307

[56] References Cited

U.S. PATENT DOCUMENTS

| | | | |
|---|---|---|---|
| 3,417,319 | 12/1968 | Shaughnessy | 323/4 |
| 4,101,823 | 7/1978 | Farmer, Jr. | 324/404 |
| 4,163,188 | 7/1979 | Culmer | 323/4 |

*Primary Examiner*—William M. Shoop
*Assistant Examiner*—Peter S. Wong
*Attorney, Agent, or Firm*—E. M. Whitacre; G. H. Bruestle; D. H. Irlbeck

[57] ABSTRACT

A precision cathode current regulator for controlling cathode current in a cathode-ray tube having a field effect transistor which is stabilized by an operational amplifier connected in a feedback mode. A second operational amplifier is electrically coupled to the field effect transistor for measuring cathode voltage accurately without affecting the regulated current.

7 Claims, 5 Drawing Figures

CURRENT REGULATOR IMPEDANCE VS. APPLIED VOLTAGE $$V_{OUT} = \text{CATHODE VOLTAGE} \times \frac{R_1 + R_{10}}{R_{11}} \times 1$$

PRECISION CATHODE CURRENT REGULATOR

BACKGROUND OF THE INVENTION

This invention relates to current regulators and particularly to a precision regulator for controlling and monitoring current to a cathode of an electron tube such as a cathode-ray tube during testing of the tube.

After a cathode-ray tube, such as a color picture tube, has been fabricated, it is necessary to test the tube to ensure that it will operate within desired tolerances. In order to attain uniformity in testing, it is important that the cathode current being supplied to the tube is accurately controlled. To date, several different types of regulators have been tried to perform this regulation. These different types have employed components such as bipolar transistors, vacuum tubes and field effect transistors. Of these components, recent developments in improving field effect transistors have made these components a preferred choice. However, there are drawbacks in using field effect transistors. These drawbacks include drift or change of current due to change in the transistor characteristics caused by temperature sensitivity and the risk of transistor damage caused by high voltage transients.

In addition to providing regulated current, it is also desirable to be able to measure the actual cathode voltage when operating at the regulated current level without actually changing that value due to the metering employed. When the circuit is regulating to a low value of current at a high input voltage, the regulator represents a high impedance. FIG. 1 illustrates the impedance of a regulator versus current and voltage. Normal methods of voltage metering require a resistive shunt which would alter the test results. Further, the shunt load also represents a non-regulated current path which would degrade regulator performance.

The present invention provides a new current regulator circuit which has better regulation than the previous concepts, is more stable and less sensitive to thermal drift, has provision for cathode voltage measurement, and takes advantage of the properties of a field effect transistor which allow operation in the depletion and/or enhancement modes.

SUMMARY OF THE INVENTION

A precision cathode current regulator for controlling cathode current in a cathode-ray tube comprises a field effect transistor which is stabilized by an operational amplifier connected in a feedback mode. Means also are included for measuring cathode voltage accurately without affecting the regulated current.

DETAILED DESCRIPTION

Figure 1:
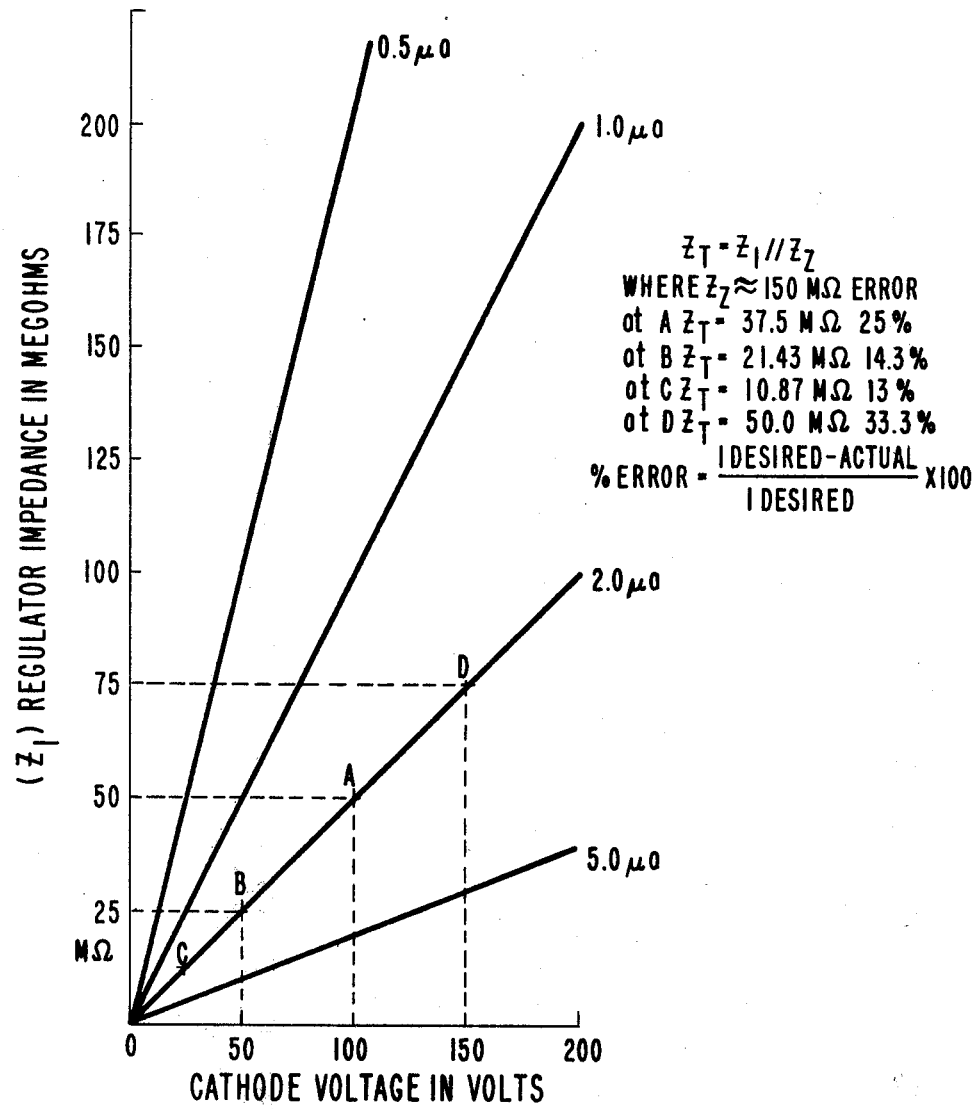
FIG. 1 is a graph of regulator impedance versus current and voltage.
Figure 2:
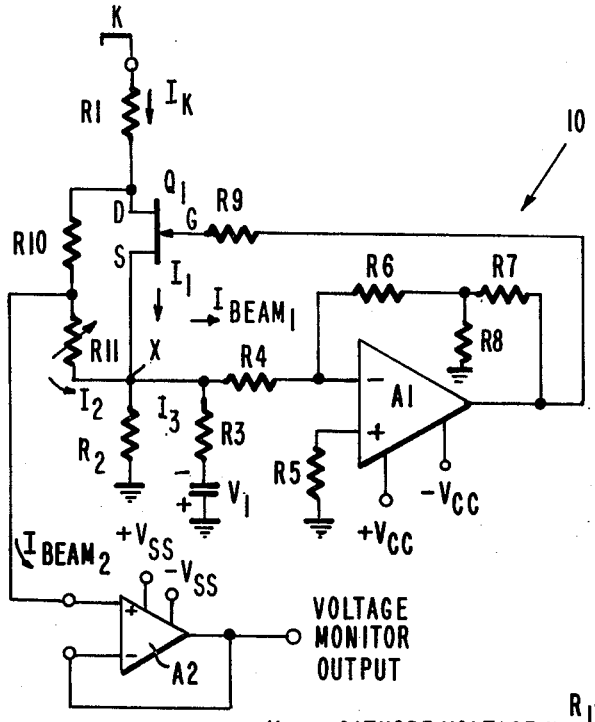
FIG. 2 is a diagram of one circuit embodying the present invention.

FIG. 2 shows a precision cathode current regulator circuit 10 containing one embodiment of the present invention. Components that are included in this circuit 10 that are similar to components in the other circuits to be described later include a field effect transistor $Q_1$ connected between a cathode K of a cathode-ray tube and a node X. The source of the transistor $Q_1$ is connected to the node X. The node X is connected to ground through a resistor $R_2$. A first operational amplifier $A_1$ has a first input connected through a resistor $R_4$ to the node. The output of the first operational amplifier $A_1$ is connected through a resistor $R_9$ to the gate of the field effect transistor $Q_1$. A second input of the first operational amplifier $A_1$ is connected to ground through a resistor $R_5$. The output of the first operational amplifier $A_1$ further is connected to this first input through two series resistors $R_6$ and $R_7$ having another resistor $R_8$ connecting a point between them to ground. A second operational amplifier $A_2$ has a first input connected through at least one resistor $R_{10}$ to the drain of the transistor $Q_1$. The output of the second operational amplifier $A_2$ is a voltage monitor output. Typical component values for this circuit 10 are given in the following table.

TABLE I

| | |
|---|---|
| $A_1$ | = OP AMP Type LM 207 |
| $A_2$ | = OP AMP Type LH 0022 |
| $Q_1$ | = FET Type 2N6449 |
| $R_1$ | = 25 MEG OHMS |
| $R_2$ | = 10 Thousand OHMS |
| $R_3$ | = 10 Thousand OHMS |
| $R_4$ | = $R_5$ = 1 Thousand OHMS |
| $R_6$ | = $R_7$ = 100 Thousand OHMS |
| $R_8$ | = 10 OHMS |
| $R_{10}$ | = 100 MEG OHMS |
| $R_{11}$ | = 5 to 10 MEG OHMS Variable |
| $V_1$ | = Variable Voltage 0 to 10 Volts D.C. |

In the circuit 10 a resistor $R_1$ is employed for circuit protection, and in the specific example has a value of 25 MEG OHMS. This value imposes a limit of 50 volts on cathode voltage at two microamperes as a minimum voltage, whereas, the maximum permissible voltage would equal the rating of the field effect transistor $Q_1$ (300 volts) plus the drop of the resistor $R_1$ at the chosen current. The value of the resistor $R_1$ should be chosen for the particular application depending on the desired regulated current and cathode voltage range, and may assume any value from zero up. A resistor $R_2$ is used to provide a voltage drop dependent upon the cathode current. Consider the current node identified as node X in FIG. 2. Since the current at node X must follow Kirschoff's law, the current entering node X is:

$$I_{T\,ENTERING}=I_1+I_2=I_K-I_{BIAS2}=I_K-0^*\cong I_K$$

*since the bias current entering the amplifier is very near zero.

And:

$$I_{T\,ENTERING}=I_{T\,LEAVING}=I_3-I_{BIAS1}=I_c-0\cong I_3$$

The combination of the regulated voltage source $V_1$ and resistor $R_3$ form, in essence, a constant current source to provide the current $I_3$.

An amplifier $A_1$ is operated in the "parallel-parallel" feedback configuration with the resistor $R_4$ being the input resistor, and the effective value of the combination of resistors $R_6$, $R_7$ and $R_8$ forming the feedback resistor. The gain of the amplifier $A_1$ is given by:

$$A_{pp} = \frac{e_o}{e_i} = \frac{R_6 + R_7 + [R_6(R_7)/R_8]}{R_4} = \frac{1 \times 10^9}{1 \times 10^3} = 1{,}000{,}000$$

A resistor $R_9$ is chosen to limit the gate current in the field effect transistor $Q_1$. Another resistor $R_5$ is used to minimize the effects of input bias currents.

The action of the circuit 10 is that of a feedback amplifier. A current is introduced into node X which causes a voltage (V error). This voltage is amplified and inverted resulting in an output voltage from the amplifier $A_1$ which is applied to the field effect transistor in such a way as to cause it to conduct. The cathode current ($I_K = I_1 + I_2$) flows into node X, causing a voltage drop opposite in polarity to that used to cause the original voltage (V error). When the two currents are equal, a voltage substantially equal to zero will be produced at node X, and the circuit will be regulating the desired current. The resistors $R_1$, $R_{10}$ and $R_{11}$ form a voltage divider. The second amplifier $A_2$ acts as a current pump with a gain of 1. The low end of this divider is returned into the summing junction of the circuit. Thus, the divider current is sensed by the regulator and the regulated current is the sum of the divider current and the current through the field effect transistor $Q_1$. The resistance of the divider imposes a maximum value of impedance on the regulator. A small error will exist in the voltage monitor output. A further improvement may be made in the foregoing circuit 10 by providing an input to the summing junction node X which represents current in the voltage monitor and causes an offset which reduces current in the field effect transistor regulator by an amount equal to that flowing through the voltage monitor. The straight forward approach would be to return the low end of the metering circuit to node X. This approach has the serious drawback that the voltage drop across the resistor $R_2$ in circuit 10 would create inaccuracy in the voltage measurements.

Figure 3:
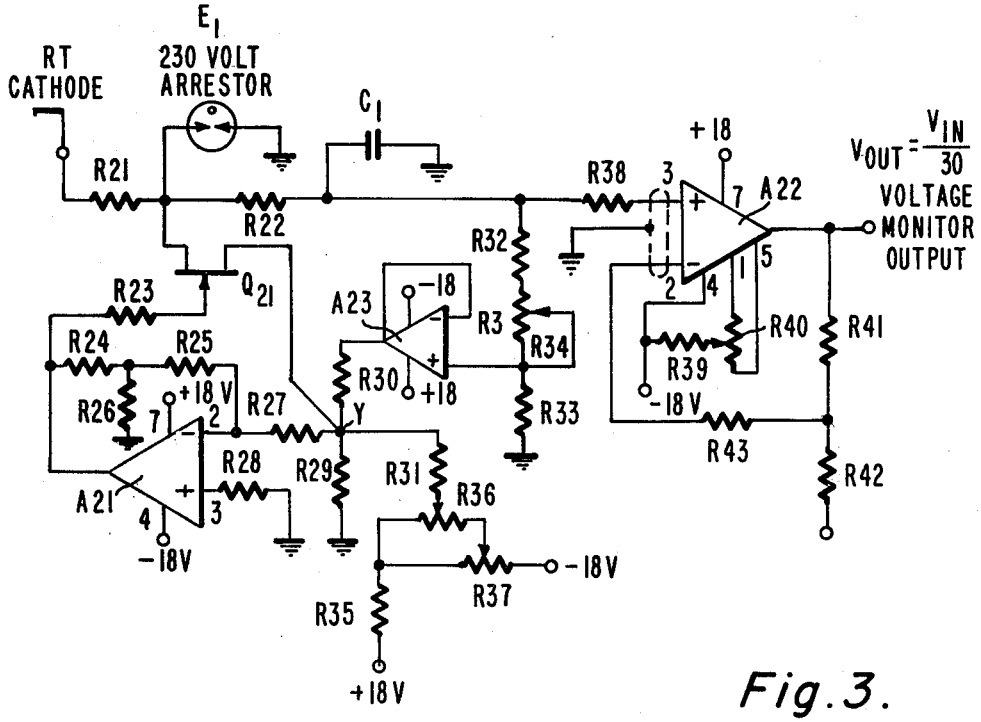
FIG. 3 is a diagram of another circuit embodying the present invention.

FIG. 3 shows a circuit 20 which uses an operational amplifier $A_{21}$ to provide the current compensating feedback while isolating the voltage monitor from node Y. The non-inverting voltage monitor amplifier $A_{22}$ operates at a gain of approximately 101 from the voltage at the low side of the resistor $R_{22}$. The potentiometer $R_{34}$ is adjusted to produce a monitor output that is equal to $1/30 \times V_{in}$, where $V_{in}$ is the cathode voltage. The operational amplifier $A_{22}$ has extremely high input impedance so that nearly all of the voltage monitor current flows through the resistor $R_{32}$, the potentiometer $R_{34}$ and the resistor $R_{33}$. An amplifier $A_{23}$ amplifies the voltage drop across the resistor $R_{33}$ by a gain of $-1$ and its output voltage in series with the resistor $R_{30}$ provides a current into node Y which causes the regulator to sense current in the divider so that the regulated current equals the current in the field effect transistor $Q_{21}$, plus the current in the voltage monitor divider, thus the regulated current is the actual cathode current so long as the regulator setting is equal to or greater than the divider current.

Typical component values for the circuit 20 of FIG. 3 are given in the following table.

TABLE II

| |
|---|
| $A_{21}$ = OP AMP Type LM207 |
| $A_{22}$ = OP AMP Type LH0022 |
| $A_{23}$ = OP AMP Type LM207 |
| $Q_{21}$ = FET Type 2N6449 |
| $R_{21}$ = 100 OHMS |
| $R_{22}$ = 500 MEG OHMS |

TABLE II-continued

| |
|---|
| $R_{23}$, $R_{24}$, $R_{31}$, $R_{38}$ = 100 K OHMS |
| $R_{26}$ = OHMS |
| $R_{27}$, $R_{28}$ = 1 K OHM |
| $R_{29}$, $R_{30}$, $R_{33}$, $R_{39}$, $R_{40}$ = 10 K OHMS |
| $R_{32}$ = 120 K OHMS |
| $R_{34}$, $R_{37}$ = 50 K OHMS |
| $R_{35}$ = 8.2 K OHMS |
| $R_{36}$ = 2 K OHMS |
| $R_{41}$, $R_{43}$ = 270 K OHMS |
| $R_{42}$ = 2.7 K OHMS |
| $C_{21}$ = 120 pf |

In addition to including a resistor $R_{21}$ between the transistor and the cathode, a voltage arrestor is also connected at one end to the resistor $R_{21}$ and the drain terminal of the transistor $Q_{21}$ with the other end connected to ground.

Figure 4:
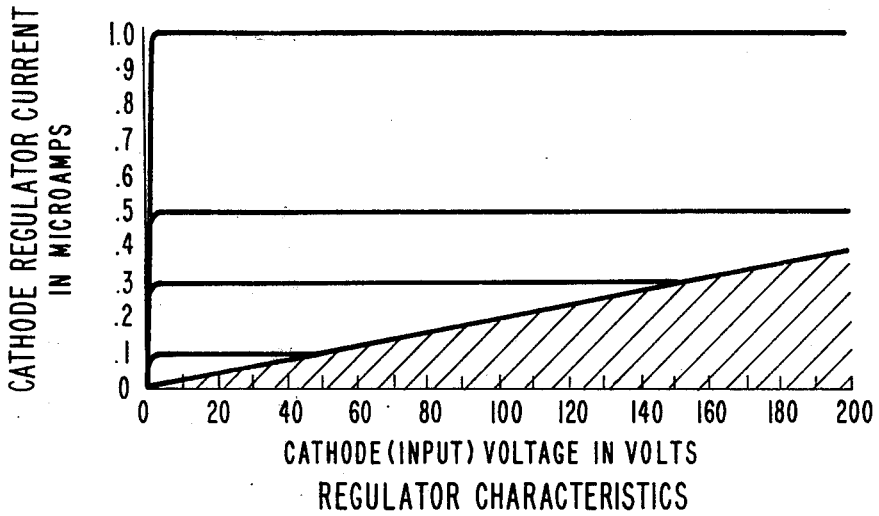
FIG. 4 is a graph of cathode current versus cathode voltage.

The graph of FIG. 4 illustrates the restriction imposed on the range of current regulation when apertured near zero current. The shaded region represents the area where divider current exceeds regulator current setting. The maximum usable range of the regulator is limited by the ratings of the field effect transistor $Q_{21}$ used and the value of the resistor $R_{31}$. In the circuit 20 shown in FIG. 3, the field effect transistor $Q_{21}$ power dissipation rating for continuous free air operation up to an ambient temperature of 50° C. and for operation up to 230 volts is a maximum current of 3 milliamps. The value of the resistor $R_{31}$ limits the circuit to about 1800 microamps. The resistor $R_{31}$ may be altered, if desired, to obtain a higher current range. The value of the resistor $R_{31}$ should be chosen to be relatively high (maximum value for desired range) in order to provide maximum resolution. All potentiometers should be cermet or film type for precision of adjustment. The foregoing circuit 20 can be easily implemented in three channels to provide for use with color picture tubes which have three separate cathodes. The circuit 20 features non-inverting voltage monitor, excellent current regulation and good voltage monitor tracking. A problem with this circuit 20 is that small changes in voltage monitor null occur with drift of the input offset of the amplifier $A_{22}$.

Figure 5:
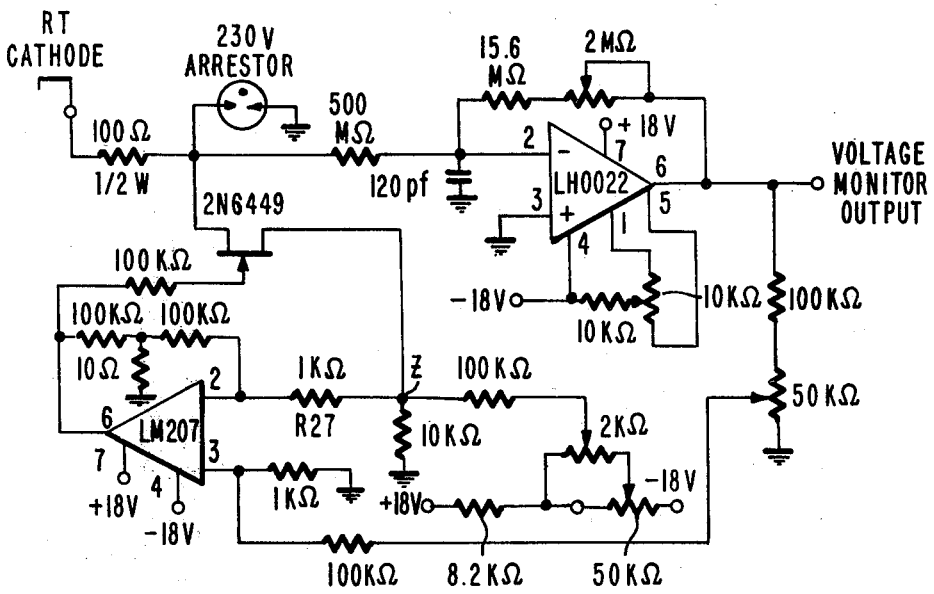
FIG. 5 is a diagram of a third circuit embodying the present invention.

FIG. 5 presents a circuit 40 with an inverting voltage monitor, minimum dull drift and excellent current regulation plus excellent voltage monitor tracking. The circuit 40 operates with compensation for voltage monitor input current in a similar manner to the circuit 20 of FIG. 3, except that the amplifier $A_{23}$ of FIG. 3 is not needed since an amplifier $A_{42}$ provides both inversion and isolation.

The foregoing embodiments provide current regulators which utilize field effect transistors and overcome the principal drawbacks of field effect transistors related to temperature sensitivity by using an operational amplifier to correct for transistor drift. In such embodiment, a feedback scheme is included whereby the regulator current is reduced proportionately to the current in a voltage monitoring device. Cathode current can also be held substantially constant as variations occur in the portion of the total current which flows in the voltage monitor portion of the regulator. Cathode current also will remain substantially unchanged even though cathode voltage is varied.

We claim:

1. A precision cathode current regulator for controlling cathode current in a cathode-ray tube comprising a field effect transistor connected between a cathode-ray tube cathode and a node, the source of said transistor being connected to the node, said node being connected to ground through a resistor, an operational amplifier having a first input connected through a resistor to said node, the output of said operational amplifier being connected through a resistor to the gate of said field effect transistor, a second input of said operational amplifier being connected to ground through a resistor, the output of said operational amplifier further being connected to the first input through two series resistors and having another resistor connecting a point between the two series resistors to ground, means for measuring cathode voltage, and means for offsetting the regulated current to compensate for current entering the means for measuring cathode voltage.

2. A precision cathode current regulator for controlling cathode current in a cathode-ray tube comprising a field effect transistor connected between a cathode-ray tube cathode and a node, the source of said transistor being connected to the node, said node being connected to ground through a resistor, a first operational amplifier having a first input connected through a resistor to said node, the output of said first operational amplifier being connected through a resistor to the gate of said field effect transistor, a second input of said first operational amplifier being connected to ground through a resistor, the output of said first operational amplifier further being connected to the first input through two series resistors and having another resistor connecting a point between the two series resistors to ground, and a second operational amplifier having a first input connected through at least one resistor to the drain of said transistor, the output of said second operational amplifier being a voltage monitor output.

3. The current regulator as defined in claim 2 including a protective resistor between the drain of said transistor and the cathode.

4. The current regulator as defined in claim 3 including an arrestor device connected at one end to said protective resistor and the drain terminal of the transistor and having the other end grounded.

5. The current regulator as defined in claim 2 including a variable resistor connected between the first input of said second operational amplifier and said node.

6. The current regulator as defined in claim 2 including a third operational amplifier having an input connected to the first input of said second operational amplifier through adjustable resistive means and an output connected to said node through a resistor.

7. The current regulator as defined in claim 2 including resistive means interconnecting the output of said second operational amplifier with the second input of said first operational amplifier.

* * * * *

UNITED STATES PATENT AND TRADEMARK OFFICE
CERTIFICATE OF CORRECTION

PATENT NO. : 4,275,347

DATED : June 23, 1981

INVENTOR(S) : Felta Carl Farmer et al.

It is certified that error appears in the above-identified patent and that said Letters Patent is hereby corrected as shown below:

(In Table I)

Column 2, line 32, "$R_6$ = $R_7$ = 100 Thousand OHMS" should read -- $R_6$=$R_7$=$R_9$= 100 Thousand OHMS --.

Column 2, line 35, "0 to 10 volts" should read -- 0 to -10 Volts --.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*